US005449869A

United States Patent [19]

Tinkham

[11] Patent Number: 5,449,869

[45] Date of Patent: Sep. 12, 1995

[54] ACTUATOR HOUSING

[75] Inventor: Ronald B. Tinkham, Solana Beach, Calif.

[73] Assignee: Systems Analysis and Integration, Inc., Orange, Calif.

[21] Appl. No.: 117,309

[22] Filed: Sep. 3, 1993

[51] Int. Cl.[6] ..... H01H 9/04

[52] U.S. Cl. ..... 200/302.1; 200/333

[58] Field of Search ..... 200/333, 293, 302.1

[56] References Cited

U.S. PATENT DOCUMENTS

| | | | |
|---|---|---|---|
| 3,233,071 | 2/1966 | Buzzell . | |
| 3,522,404 | 8/1970 | Trayer | 200/302.1 |
| 3,594,525 | 7/1971 | Miller . | |
| 3,662,128 | 5/1972 | Neudorfer et al. . | |
| 4,051,340 | 9/1977 | Wolski . | |
| 4,095,061 | 6/1978 | Bridges . | |
| 4,234,774 | 11/1980 | Paparella | 200/333 X |
| 4,596,906 | 6/1986 | Chabala et al. . | |
| 4,622,443 | 11/1986 | Mooz . | |

OTHER PUBLICATIONS

Photograph of Stainless Steel Enclosure, Systems Integrated, San Diego, Calif.—no date.

*Primary Examiner*—Renee S. Luebke

*Attorney, Agent, or Firm*—Knobbe, Martens, Olson & Bear

[57] ABSTRACT

A load bearing housing provides environmental protection and submergibility to an actuator and associated control electronics housed within, and effectively carries the resultant stresses and moments produced by the actuator when actuated. The housing comprises a plastic enclosure which generally seals the actuator and control electronics within an internal cavity. A metal bracket supports the actuator within the enclosure. The enclosure is connected to a rigid, metal strong back which reinforces the bottom and lower sides of the enclosure. The bracket also attaches to the strong back such that when the actuator is actuated, the bracket and strong back carry the resultant stresses and moments. The plastic enclosure is substantially isolated from such stresses, and, thus, is less likely to fracture.

24 Claims, 5 Drawing Sheets

ACTUATOR HOUSING

BACKGROUND OF THE INVENTION

1. Field of the Invention

The present invention relates in general to a load bearing housing, and in particular to a housing for an actuator.

2. Description of Related Art

Several power utility companies have recently employed automated power grid networks to redistribute or re-route electricity throughout a service area. These power companies re-route power distribution via remote power distribution switches located throughout a city or community. Actuators attached to these switches are used to throw the switches to re-route the power.

The actuator is normally mounted on top of a box housing the power distribution switch. An actuator shaft of the actuator is coupled to a lever of the distribution switch such that movement of the actuator shaft moves the lever to throw the switch.

Each actuator is electronically connected to a control card which selectively powers the actuator when instructed to do so by a central control system. The control card and central control system typically communicate via modems and telephone lines. When the central control system signals a particular control card to switch the corresponding power distribution switch, the control card connects an electric motor of the actuator to a source of power. The electric motor drives the actuator shaft in the desired direction to move the lever and throw the switch.

Underground vaults typically house the power distribution switches and actuators. Many vaults are susceptible to flooding and are dirty. The environment within the vaults may also be somewhat caustic. These conditions can affect the operation of the actuators and control electronics.

SUMMARY OF THE INVENTION

A need therefore exists for an enclosure which provides environmental protection to the actuator and control electronics from the elements within the vault, as well as for submergibility to the actuator and control electronics. There is also a need to provide a comparatively inexpensive enclosure.

The present invention provides a lightweight, relatively inexpensive, housing for an actuator of the type used to switch large power distribution switches. The housing protects the actuator and associated control electronics from the surrounding environment. It is also preferred that the housing be submergible.

The housing comprises an enclosure and a strong back. The enclosure is preferably made of a lightweight, non-metallic material, such as, for example, plastic or a composite, so as to lighten the weight of the enclosure, as well as to reduce manufacturing costs. Plastics or other suitable composites are preferred over metals because of material and manufacture cost savings. However, it is economically impractical to construct a housing comprised entirely of known plastic which can carry the stresses produced during actuator actuation.

The strong back of the present invention is designed to carry a significant portion of such stresses. The strong back connects to the exterior of the enclosure, and is coupled to the actuator such that the strong back carries a significant portion of the resultant stresses and moments produced when the actuator is actuated. In this manner, the enclosure is generally decoupled from the resultant stresses. The enclosure principally serves to seal at least a portion of the actuator from the surrounding environment.

In a preferred embodiment, the enclosure is sized to receive at least a portion of the actuator. The enclosure further defines an opening of a size through which the actuator rod can pass. The strong back attaches to the bottom of the enclosure. The housing additionally comprises a bracket which is connected to the strong back and positioned within the enclosure. The bracket is configured to fixedly support an end of the actuator opposite the actuator rod. In this embodiment, the strong back and the bracket principally carry the resulting stresses.

The strong back preferably comprises at least one longitudinal rail to strengthen the strong back along its length. The rail forms a channel which receives a portion of the enclosure to attach the strong back to the enclosure.

The strong back more preferably comprises first and second rails which run along the longitudinal sides of a base plate. Additionally, the enclosure comprises first and second longitudinal grooves. The first and second grooves receive a portion of the first and second rails, respectively, to attach the strong back to the enclosure. The base plate desirably covers a substantial portion of the bottom of the enclosure.

Additionally, the housing may comprise a bellows. The bellows extends between the actuator rod and the enclosure to seal the opening through which the actuator rod passes. The housing may also comprise a rear mount to connect a rear end of the housing to a box which houses the power distribution switch (hereinafter "switch box"). The housing may further comprise a clamp which engages the lever of the switch to attach a forward end of the housing to the switch box.

Another aspect of the present invention provides a combination of an actuator and a housing. The actuator is generally sealed within an enclosure of the housing with an actuator rod extending through an opening of the enclosure. A strong back attaches to the enclosure. A bracket couples the actuator to the strong back so as to generally isolate the enclosure from the stresses produced when the actuator is actuated.

In accordance with a preferred method of providing environmental protection to an actuator, an enclosure is formed having a hollow cavity. A bracket is positioned in the cavity and is coupled to a strong back. The actuator is inserted into the cavity and is fixedly secured to the bracket. An actuator rod of the actuator is extended through an opening in the enclosure. The enclosure is sealed to protect the actuator from the surrounding environment.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF THE PREFERRED EMBODIMENT

Figure 1:
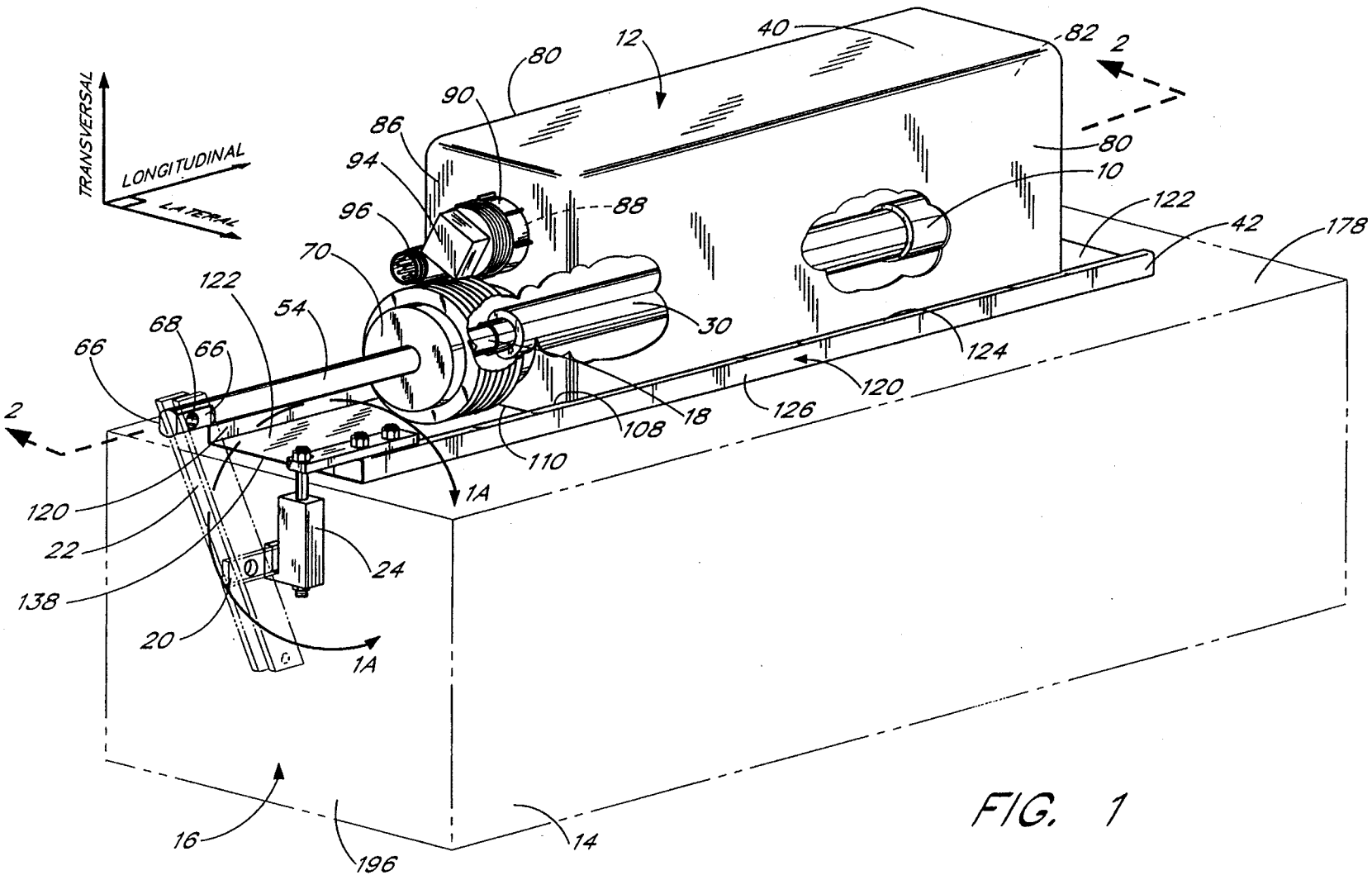
FIG. 1 is a front perspective view of an actuator housing assembly in accordance with a preferred embodiment of the present invention.

FIG. 1 illustrates an actuator 10 housed within a housing 12 configured in accordance with a preferred embodiment of the present invention. The housing 12 is attached directly to a box 14 of a conventional power distribution switch 16 (e.g., a Joslyn SF6 Switch), preferably to the top of the box 14. An actuator rod 18, which extends out the front of the housing 12, connects to a lever 20 of the power distribution switch 16 via a linkage 22. Mounting attachments, such as a forward clamp 24 and/or a rear mount 26 (see FIG. 5) may be used to attach the housing 12 to the box 14.

Figures 2, 2A:
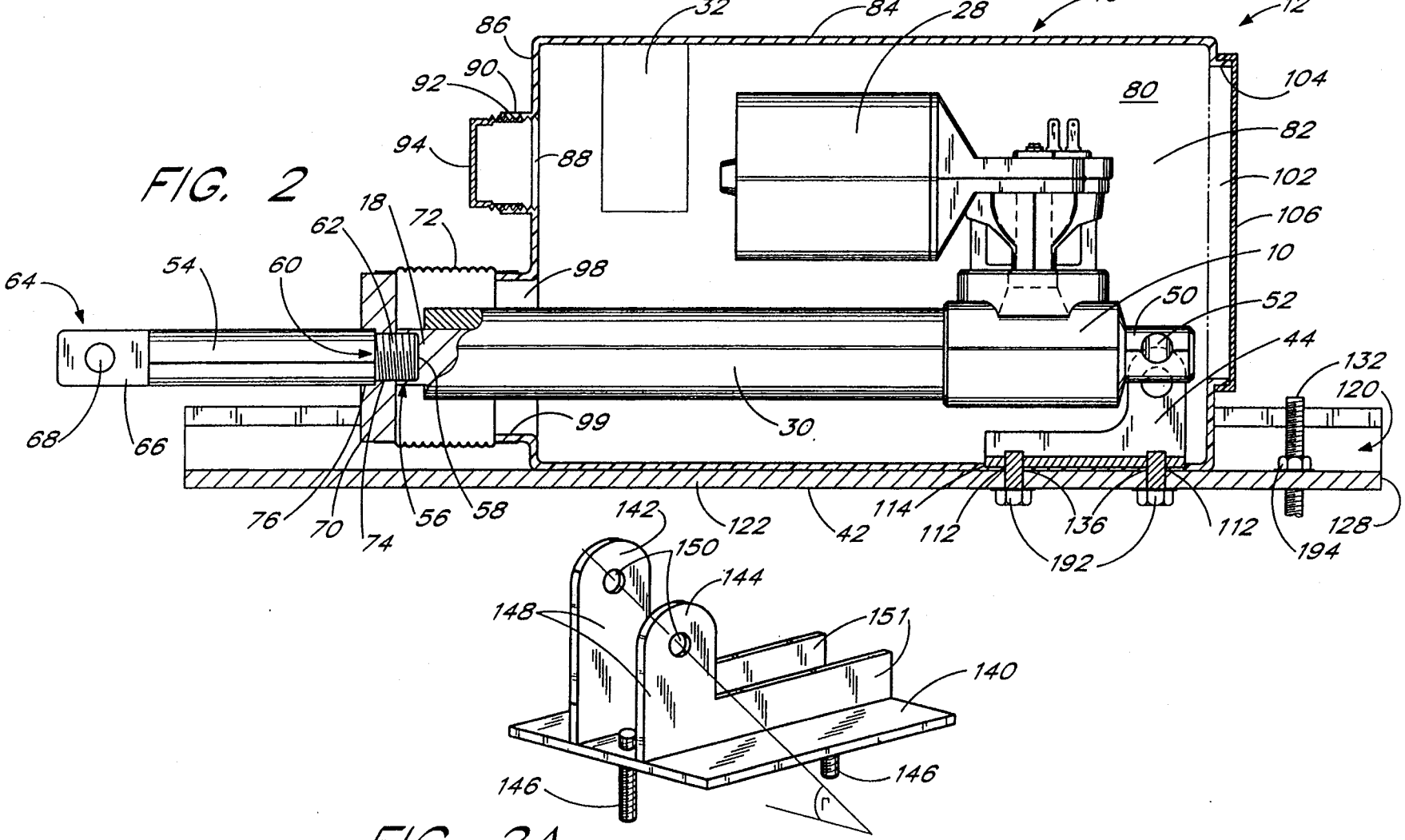
FIG. 2 is a cross-sectional view of the actuator housing assembly taken along line 2—2 of FIG. 1.
FIG. 2A is a top perspective view of a bracket of the actuator housing assembly of FIG. 2.

As best seen in FIG. 2, the housing 12 encloses at least a portion of the actuator 10, and preferably encloses an electrical motor 28 and a cylinder 30 of the actuator 10. Advantageously, the housing 12 generally hermetically seals the actuator 10 within the housing 12 to protect the actuator 10 against damage caused by flooding or by dirt, grime or caustic elements.

The housing 12 may also enclose a control card 32. The control card 32 comprises a PC board which supports a computer platform including a microprocessor (not shown), as well as potentiometers (not shown). The potentiometers can be adjusted to control the "stops" or travel of the actuator 10, as know in the art. The control card 32 also includes a modem (not shown) which links the computer platform to a central control system of the power distribution network located at a remote location.

FIG. 1 illustrates that the housing 12 principally comprises a hollow enclosure 40 and a strong back 42 attached to the enclosure 40. The strong back 42 is interposed between the enclosure 40 and the distribution switch box 14 when the housing 12 is attached to the switch box 14. A bracket 44, as seen in FIG. 2, supports the actuator 10 within the housing 12 and is connected to the strong back 42.

The strong back 42 and bracket 44 are designed to carry the resultant stresses produced when the actuator 10 is actuated. In this manner, the enclosure 40 is generally isolated from the resultant stresses. The enclosure 40 principally serves to enclose the actuator from the environment within the vault. Thus, the enclosure can be formed of plastic or other light weight material to minimize the weight of the enclosure and to reduce manufacturing costs.

FIG. 1 illustrates a longitudinal axis, a transverse axis and a lateral axis in relation to the actuator housing 12 to facilitate the following description. Additionally, as used herein, "the longitudinal direction" refers to a direction substantially parallel to the longitudinal axis. "The lateral direction" and "the transverse direction" are likewise in reference to the lateral axis and transverse axis, respectively. Also, "front" and "rear" are in reference to the proximity of the distribution switch lever 20 (see FIG. 1). The individual components of the housing 12/actuator 10 assembly will now be described in detail.

THE ACTUATOR

FIG. 2 best illustrates that the actuator 10 preferably comprises a screw drive linear actuator, such as the type commercially available from Warner Electric of Dana Point, Calif. However, although the actuator 10 is described and illustrated in terms of a linear actuator, it is contemplated that other types of actuators, such as, for example, a rotational actuator, could be used as well with the housing 12. The linear actuator 10 comprises the actuator rod 18 slidably positioned within the cylinder 30. The electric motor 28 drives the actuator rod 18 back and forth in the longitudinal direction.

The actuator 10 also includes a rear, stationary support stud 50 which is used to fix the rear end of the actuator 10. The support stud 50 defines an aperture 52 with an axis positioned generally perpendicular to the longitudinal axis of the actuator 10.

An extender 54 desirably attaches to a forward end 56 of the actuator rod 18, preferably by a screw connection. That is, the forward end 56 of the actuator rod 18 includes a threaded bore 58 and the rear end 60 of the extender 54 includes a correspondingly threaded stud 62. The extender 54 desirably has a cylindrical shape of a diameter substantially equal to that of the actuator rod 18. The forward end 64 of the extender 54 has a pair of diametrically opposed flat surfaces 66 and an aperture 68 which extends between the flat surfaces 66, through the extender 54 and generally in the lateral direction.

As best seen in FIG. 2, an annular collar 70 is interposed between the extender 54 and the actuator rod 18. The collar 70 has a diameter sized to support a forward end of a bellows 72, as discussed in detail below.

The collar 70 includes a central aperture 74 with a counter bore 76 circumscribing the central aperture 74. The central aperture 74 is sized to receive the threaded stud 62 of the extender 54 and the counter bore 76 is sized to receive a portion of the cylindrical extender 54 adjacent to the threaded stud 62. When assembled, the extender 54 secures the collar 70 to the forward end 56 of the actuator rod 18.

THE ENCLOSURE

FIG. 1 illustrates that the enclosure 40 generally has a rectangular box shape formed in part by opposing, rectangular-shaped side walls 80. However, as will be readily appreciated by one skilled in the art, enclosures incorporating the present invention can be manufactured in any of a wide variety of sizes and configurations, in addition to the one disclosed herein, depending upon the specific application of the housing 12.

Within the sidewalls 80, the enclosure 40 defines an internal cavity 82 sized to receive at least a portion of the actuator 10. As best seen in FIG. 2, the electric motor 28 and the actuator cylinder 30, as well as the control card 32, preferably fit within the internal cavity 82. A bolt or rivet (not shown) secures the control card 32 inside the enclosure 40, preferably to a top panel 84 of the enclosure 40, proximate to a front panel 86.

FIG. 1 illustrates that the front panel 86 of the enclosure 40 preferably has a flat, generally rectangular shape and defines an aperture 88 of sufficient size to allow access to the control card 32 mounted inside the enclosure 40. An annular flange 90 circumscribes the aperture 88 and extends forward from the front panel 86 of the enclosure 40. The flange 90 includes internal thread 92 (see FIG. 2), preferably in accordance with the National Pipe Thread standard. A plug 94, having corresponding external threads, inserts into the annular flange 90 to seal the aperture 88. The plug 94 is preferably a conventional clean-out-type plug available commercially from McMaster-Carr of Los Angeles, Calif.

FIG. 1 also illustrates that the front panel 86 supports an electrical connector 96 for power and control communication input. The connector 96 is adapted to engage a corresponding receptacle connector to connect the electronics inside the enclosure 40 with a source of electrical power and a modem line, such that the control card 32 communicates with the central control system. Preferably, the connector 96 is a pin-type connector, commercially available McMaster-Carr. Internal wiring (not shown) connects the connector 96 to the control card 32 (see FIG. 2) and to the electrical motor 28 of the actuator 10. The connector 96 sits against the enclosure front panel 86 and is preferably sealed against the panel 86 by a washer, an O-ring, a rubberized, insulation-type, silicon caulking, or the like.

As best seen in FIG. 2, the front panel 86 further includes a central opening 98 for the actuator rod 18. The central opening 98 preferably has a generally circular shape of a diameter larger than that of the actuator cylinder 30. An annular flange 99 circumscribes the central opening 98 and extends in the longitudinal direction away from the front panel 86. The flange 99 desirably has a longitudinal width of sufficient size to support a connector, such as, for example, a hole clamp (not shown), which is used to secure the bellows 72 to the enclosure 40, as discussed below. An outer diameter of the annular flange 99 preferably matches that of the annular collar 70 attached to the actuator rod 18.

Figure 3:
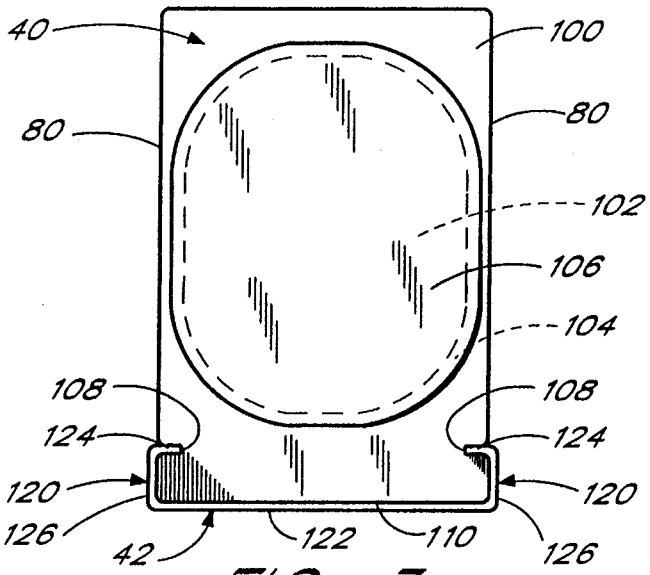
FIG. 3 is a rear elevational view of the actuator housing assembly of FIG. 1.

FIG. 3 illustrates a rear panel 100 of the enclosure 40 which defines an opening 102. The opening 102 provides access into the internal cavity 82 of the enclosure 40 to facilitate installation and removal of the actuator 10 and the internal electronics. The opening 102 preferably has an oval or elliptical shape. It has been found that such shape provides a superior seal over other shapes having a sufficient size for the actuator to pass through. That is, the oval shape has proven beneficial in holding a seal. It is contemplated, however, that other shapes can be used as well, depending upon the specific application of the enclosure 40. A flange 104 (see FIG. 2 and 3) circumscribes the access opening 102 and projects outwardly, away from the internal cavity 82 of the enclosure 40.

As seen in FIGS. 2 and 3, the enclosure 40 includes a removable rear cap 106 which covers the access opening 102 of the rear panel 100. The cap 106 has a corresponding shape to that of the opening 102 and snugly fits over the flange 104. A hose clamp (not shown) may be used to secure the cap 106 onto the flange 104. It is contemplated, however, that other types of attachment means, such as, for example, interlocking grooves and ribs on the cap 106 and flange 104, can be used as well to secure the cap 106 to the enclosure 40.

As illustrated in FIGS. 1 and 3, each side wall 80 defines a longitudinal groove 108 which extends along the length of side wall 80 proximal to a bottom panel 110 of the enclosure 40. Each side wall 80 juts into the internal cavity 82 to form the groove 108 on its exterior side. The groove 108 has a depth, as measured in the lateral direction, sized to receive a portion of the strong back 42 to attach the strong back 42 to the enclosure 40, as discussed below.

The grooves 108 desirably oppose each other and are coextensive with the side walls 80 in the longitudinal direction. The position of the grooves 108 above the bottom surface 110 is desirably selected to coincide with the height, as measured in the transverse direction, of the strong back 42.

As best seen in FIG. 2, the bottom panel 110 defines a pair of through holes 112. The through holes 112 are positioned proximate to the rear panel 80 of the enclosure 40 and are generally aligned with each other in the longitudinal direction. More preferably, the holes 112 are aligned in the longitudinal direction with the axis of the central opening 96 of the front panel 86.

About the through holes 112, the enclosure bottom 108 defines a recess 114 sized to receive a portion of the bracket 44. The recess 114 preferably has a shape similar to that of a base 140 of the bracket 44 (discussed in detail below) so as to generally orientate the bracket 44 within the interior cavity 82 when assembled.

The enclosure 40 is preferably rotationally molded of a hardened plastic, such as, for example, a low-density linear polyethylene, available commercially as PAXON™ from Allied Signal, as MARLEX™ from Phillips Chemical, or as #636 from Novacor. It is contemplated, however, that other materials, such as, for example, composite materials or other plastics with or without fillers and laminates, could be used as well. Additionally, those skilled in the art will appreciate that the enclosure 40 can also be constructed by blow molding, injection molding, transfer molding, vacuum molding or similar methods known or developed in the art. The enclosure 40 preferably has a generally uniform thickness which is less than ½ inch (1.5 cm) and more preferably equals about ⅛ inch (0.03 cm).

STRONG BACK

Figure 4:
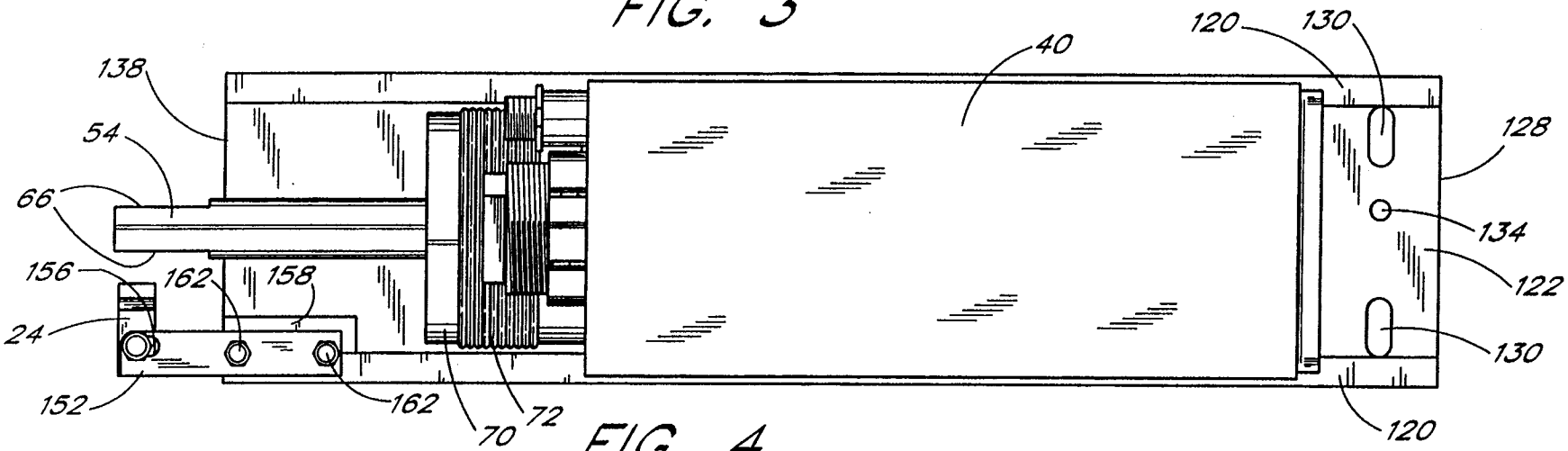
FIG. 4 is a top plan view of the actuator housing assembly of FIG. 1.

FIGS. 1, 3 and 4 best illustrate the strong back 42. The strong back 42 comprises a pair of opposing side rails 120 supported by a rectangular base plate 122. Each rail 120, as seen in FIG. 3, has an inverted "L" shape and is attached to the longitudinal sides of the base plate 122. An upper horizontal member 124 of the rail 120 extends towards the center of the strong back 42 and is attached to a vertical member 126. The vertical member 124 attaches to the base and, as seen in FIG. 1, extends along the length of the base plate 122.

The vertical member 126 has a height selected to prevent the base plate 122 from bending when subjected to the moment produced when the actuator is actuated. That is, the height of the vertical member 126 is chosen to sufficiently increase the moment of insertion (I) of the strong back 42 to carry the resultant bending moment produced when the actuator 10 throws the power distribution switch 16. In an exemplary embodiment for use with a Joslyn SF6 switch, in which the resultant force on the housing 12 is as much as 1000 pounds, the height of the vertical members 126 is preferably about ¾ inch (1.9 cm). It is contemplated, however, that the height of the vertical number 126 can readily be selected by those skilled in the art to suit specific strength requirement of a given application.

FIG. 3 illustrates that the base plate 122 has a width defined between the rails 120 generally equal to the width of the enclosure bottom panel 110. The length of the base plate 120 is generally equal to a distance between the front surface 196 of the switch box 14 and a pair of conventional mounting studs (see FIG. 2) positioned on the top of the box 14. For instance, in an exemplary embodiment, for use with a Joslyn SF6 switch, the length of the base plate 122 is desirably 20.5 inches (52 cm). However, the length of the base plate 122 can readily be customized to suit the specific size of switch box 14.

As best seen in FIG. 4, the base plate 122 defines at least one mounting aperture positioned proximate to a rear edge 128, and more preferably defines a pair of slots 130 positioned to generally coincide with the position of the mounting studs 132 (see FIG. 2) on an upper surface 178 of the switch box 14. As illustrated in FIG. 4, the slots 130 extend in the lateral direction to compensate for variations in position of the mounting studs 132. The base plate 122 may also include a hole 134 used to attach the rear mount 26 to the base plate 122, as discussed below.

FIG. 2 illustrates that the base plate 42 includes a pair of holes 136 which desirably correspond to the through holes 112 of the enclosure bottom panel 110. That is, the holes 136 of the base plate 42 generally align with the through holes 112 of the enclosure bottom panel 110. The holes 136 preferably lie along the longitudinal axis of the strong back 42. The base plate holes 136 are positioned forward of the slots 130 and sufficiently distanced therefrom such that, with the holes 136 aligned with the enclosure through holes 112, the slots 130 remain exposed (i.e., the enclosure 40 does not cover the slots 130).

Figure 1A:
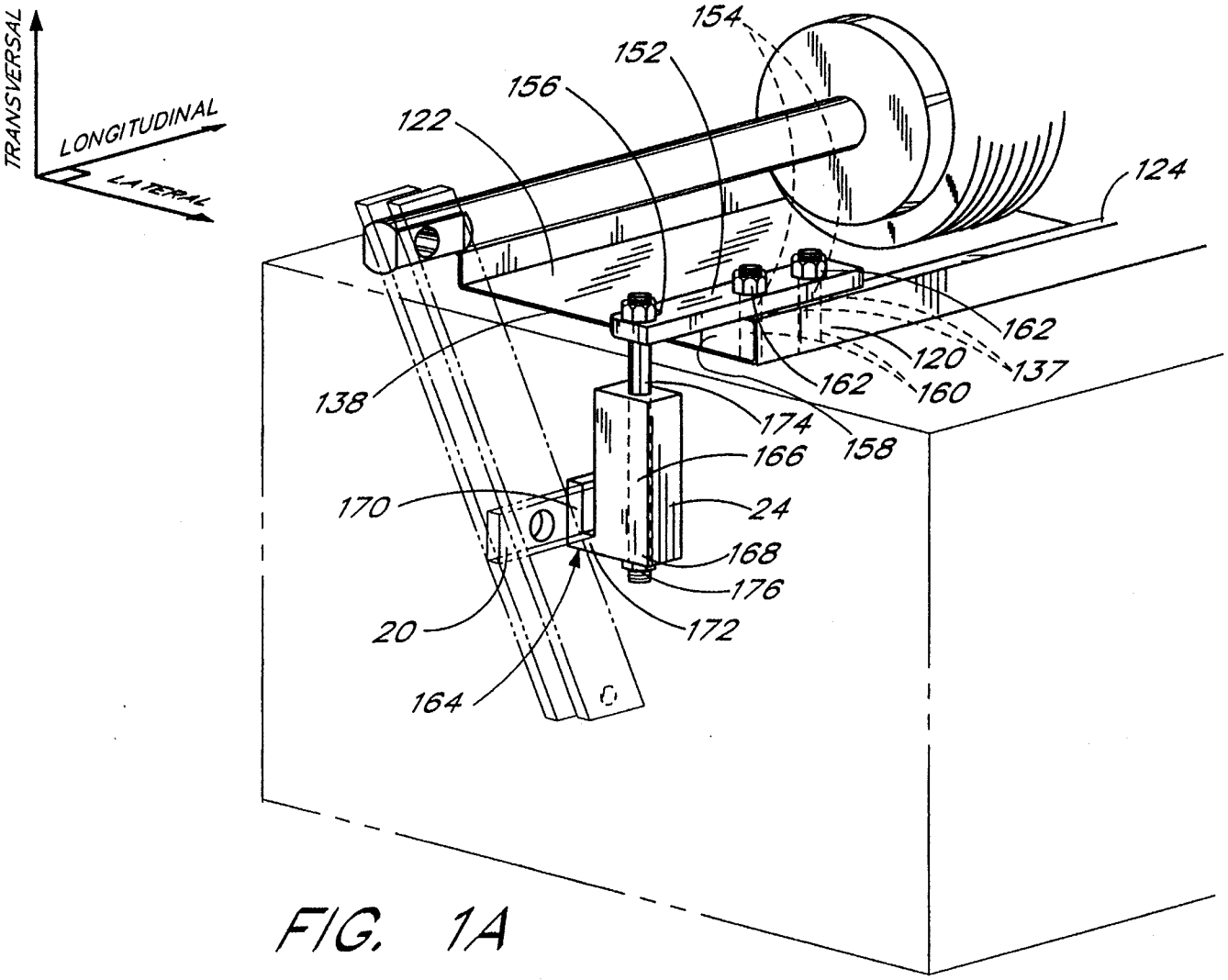
FIG. 1A is an enlarged perspective view of the area within line 1A—1A of FIG. 1 illustrating a front mounting attachment of the actuator housing assembly.

The strong back 42 includes at least one mounting hole which is used to attach the front mounting attachment to the strong back 42. FIG. 1A illustrates an exemplary embodiment where the horizontal member 124 of one rail 120 defines a pair of mounting holes 137 positioned proximate a front edge 138 of the strong back 40. The mounting holes 137 extend through both the horizontal member 124 and the base plate 122 below the horizontal member 124. Although the figures illustrate that the front mounting attachment is connected to the strong back 42 by nuts and bolts extending through the mounting holes 137, it is understood that the front mounting attachments could be fastened to the strong back 42 by similar means, such as, for example, by rivets, by welding or by integrally forming the components together. It is also contemplated that the mounting attachment could be attached to the strong back 42 at a variety of other locations, depending upon the specific application of the housing 12.

The strong back 42 is desirably stamped from a sheet of rigid material having a sufficiently large yield strength to withstand the stresses and moments placed upon the strong back 42 as a result of actuator actuation. The strong back 42 is preferably formed of a metal or metal alloy, and is more preferably formed of a corrosion-resistant metal alloy, such as, for example, 11 GA PL Stainless Steel. The strong back 42 can also be fabricated by other known or developed methods which would be apparent to one skilled in the art. Additionally, as those skilled in the art will readily appreciate, the strong back can alternatively be formed of any of a variety of composite materials which have the required strength and rigidity properties.

BRACKET

FIG. 2A illustrates the bracket 44 used to fixedly support the support stud 50 of the actuator 10. The bracket 44 comprises a base 140 supporting a pair of generally parallel, upstanding legs 142, 144. Two studs 146, preferably threaded, extend from the bottom of the base 140. The studs 146 are used to attach the bracket 44 to the base plate 122 of the strong back 42, as discussed below. The studs 146 are preferably symmetrically positioned between the legs 142, 144, as well as positioned along the longitudinal axis of the base 140. The studs 146 are desirably welded to the base 140, but preferably only on the top side of the base 140. It is understood, however, that the studs 146 could attach to the base 140 by similar means.

The base 140 preferably has a generally rectangular, plate-like shape of a sufficient size to stabilize the bracket 44 when the actuator 10 acts against the bracket 44. In an exemplary embodiment for use with a Joslyn SF6 switch, in which the resultant force applied to the bracket 44 is as much as 1,000 pounds, the base 140 of the bracket 44 preferably has a width, as measured in the lateral direction, of about 3.0 inches (7.6 cm) and a length, as measured in the longitudinal direction, of about 3.5 inches (8.9 cm). The thickness of the base 140, as measured in the transverse direction, is preferably 3/16 inch (0.5 cm). It is contemplated, however, that the size of the base 140 can readily be selected by those skilled in the art to suit the specific strength requirement of a given application.

Each leg 142,144 generally has an "L" shape. An upper portion 148 of each leg 142, 144 has a rounded end and defines an aperture 150. A lower portion 151 of each leg 142, 144 attaches to the base 140 and extends along the length of the base 140. The legs 142, 144 are preferably welded to the base 140.

The first leg 142 desirably has a transverse height greater than that of the second leg 144 so that the corresponding apertures 150 are misaligned in the transverse direction. That is, an axis extending between the apertures 150 is skewed relative to the base 140. As discussed more fully below, the axis is skewed from the base by a sufficiently oblique angle $\Gamma$ to tilt the actuator 10 to one side and thus reduce the overall transverse height of the actuator 10/bracket 44 assembly. In an exemplary embodiment, the oblique angle $\Gamma$ of the axis preferably ranges between 5° and 25°, and more preferable equals about 15°.

The bracket 44 is desirably formed of a rigid material having a sufficiently large yield strength to withstand the stresses and moments placed upon it as a result of actuator actuation. The bracket 44 is preferably formed of a metal or metal alloy, and is more preferably formed of a corrosion-resistant alloy, such as, for example, 11 GA PL Stainless Steel. However, as those skilled in the art will readily appreciate, the bracket 44 can alternatively be formed of any of a variety of composite materials which have the required strength and rigidity properties.

MOUNTING ATTACHMENTS

The front mounting attachment comprises the clamp 24 suspended from a support arm 152. FIG. 1A illustrates an exemplary embodiment in which the support arm 152 is attached to the horizontal member 124 of one of the strong back rails 120. As mentioned above, it is contemplated that the position at which the support arm 152 is attached to the strong back 42 will depend upon the specific application of the housing 12, and may be readily ascertained by those skilled in the art.

As seen in FIG. 1A, the support arm 152 desirably has a generally rectangular shape with a pair of holes 154 positioned to coincide with the holes 137 defined in the forward end of the strong back rail 120. The forward end of the support arm includes a slot 156.

A rectangular bar 158, which has apertures 160 corresponding to those of the rail 120 and base plate 122, is positioned within the channel formed by the rail 120 and base plate 122. The bar 158 strengthens the strong back 42 at the point of attachment of the support arm 152. A pair of fasteners 162, such as, for example, corresponding nuts and bolts, interconnect the strong back 42, support arm 152 and bar 158. When assembled, the support arm 152 extends beyond the front edge 138 of the strong back 42.

FIG. 1A illustrates the clamp 24. The clamp 24 comprises a hook 164 which captures at least a portion of the switch lever 20. The clamp 24 also comprises a generally rectangular block-like body 166. A transverse hole 168 extends through the body 166 in the transverse direction. The hook 164 extends from the bottom of the body 166, off to one side, and generally has an "L" shape. A vertical leg 170 of the hook preferably has a height, as measured in the transverse direction, substantially equal to the width of the switch lever 20. A horizontal leg 172 of the hook 24 desirably has a length, as measured in the lateral direction, equal to or greater than the thickness of the switch lever 20, such that the hook 164 surround at least the bottom portion of the switch lever 20 when installed, as discussed below.

A bolt 174 extends through the slot 154 of the support arm 152 and through the transverse hole 168 of the clamp 24. A nut 176 holds the clamp 24 on the bolt 174. The bolt 174 thus suspends the clamp 24 from the support arm 154.

Figure 5:
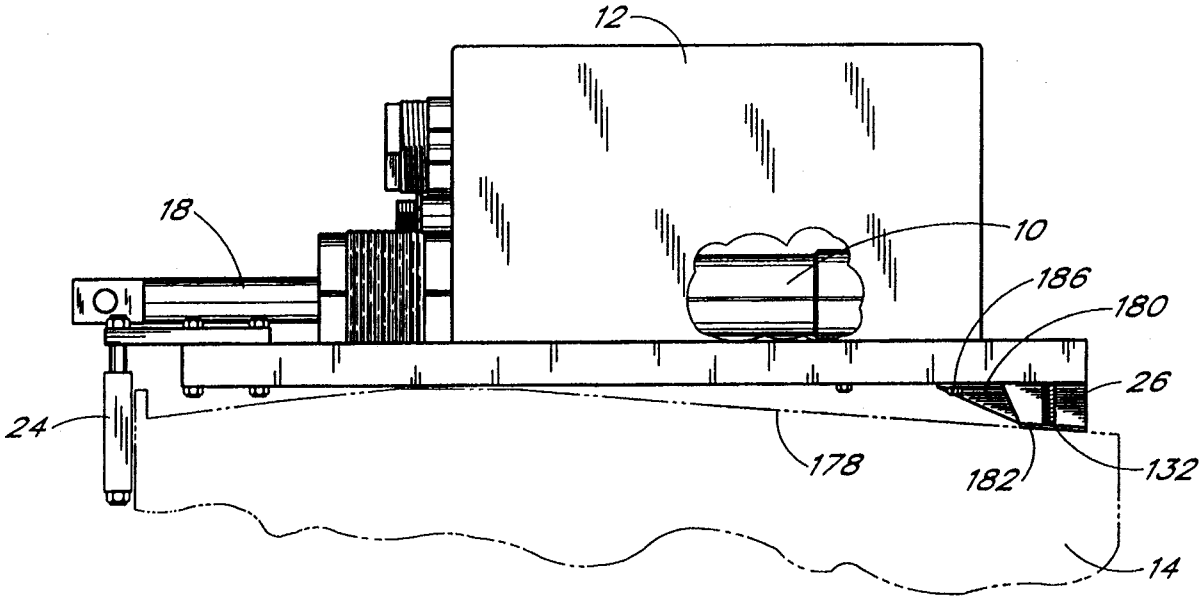
FIG. 5 is a schematic side elevational view of a rear mount used to support the actuator housing assembly of FIG. 1 on a conventional distribution switch box having a bowed upper surface.
Figure 7:
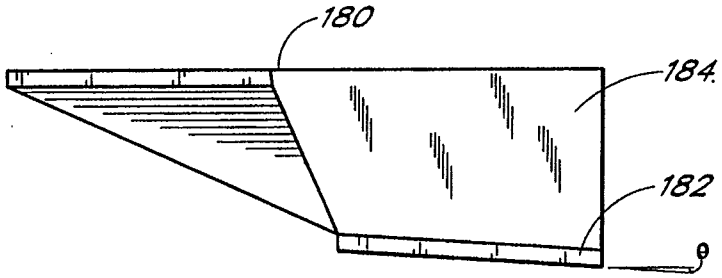
FIG. 7 is a side elevational view of the rear mount of FIG. 5.
Figure 6:
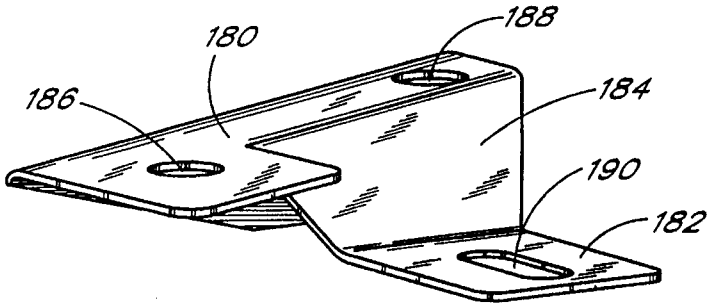
FIG. 6 is a top perspective view of the rear mount of FIG. 5.

FIGS. 5 through 7 illustrate the rear mount 26. The rear mount 26 enables the strong back 42 to be attached to the upper surface 178 of the switch box 14 in cases where the upper surface 178 bows outwardly, as schematically illustrated in FIG. 5.

FIG. 6 illustrates that the rear mount 26 comprises a platform 180 supported by a pair of feet 182. A pair of strut-like elements 184 connect the platform 180 to the feet 182.

The platform 180 has a sufficient size to support the rear end 128 of the strong back 42. The platform 180 includes a front hole 186 positioned to correspond with the rear bracket hole 136 of the strong back base plate 122. The platform 180 also includes a rear hole 188 positioned to correspond with the rear mount hole 134 of the strong back base plate 122. The platform 180 has an "L" shape. The position of the rear hole 188 desirably coincides with the center line of the rear mount 26. The front hole 186 is positioned off to the side, in the lateral direction, of the center line. The distance in the lateral direction between the front hole 186 and the rear hole 188 desirably matches the distance between the rear mount hole 136 and the rear mount hole 134 of the base plate 122.

The feet 182 extend outwardly from the center line of the rear mount 26. The feet 182 desirably have a sufficient size to stabilize the rear end 128 of the housing 12 when attached to the switch box 14. Each foot 182 defines a slot 190 sized to receive the corresponding mounting stud 132 (see FIG. 5) of the switch box 14. The spacing between the slots 190 desirable corresponds to the spacing between the mounting studs 132, and preferably matches the spacing between the rear slots 130 of the strong back 42.

The strut-like elements 184 support the platform 180 above the feet 182. These elements 184 desirably have a generally rectangular, plate-like configuration and, as viewed in the transverse direction, extend generally normal to the platform 180 and to the feet 182. As best seen in FIG. 7, the feet 182, as attached to these elements 183, are skewed relative to the platform 180. The incline angle Θ by which the feet 182 are skewed preferably ranges between 1° and 30°, and more preferably equals about 3° to 4°. It is contemplated, however, that the incline angle can readily be customized to suit specific installation requirements.

The rear mount 26 is desirably stamped from a sheet of rigid material having a sufficiently large yield strength to withstand the stresses and moments placed upon it as a result of actuator actuation. The rear mount 26 is preferably formed of a metal alloy and more preferably a corrosion resistant alloy, such as, for example, 11 GA PL Stainless Steel. It is contemplated, however, that the rear mount 26 can be constructed in any of a variety of way which will be well know to one of skill in the art.

ACTUATOR/HOUSING ASSEMBLY

FIGS. 1 and 2 illustrate the assembled housing 12 and actuator 10. The enclosure 40 of the housing 12 is slid between the rails 120 of the strong back 42 with the bottom panel 110 of the enclosure 40 sitting on the base plate 122. As best seen in FIG. 2, the enclosure 40 is slid between the rails 120 to a position in which the holes 112 in the bottom panel 110 align with the corresponding holes 136 in the base plate 120 of the strong back 42.

As seen in FIG. 3, the horizontal member 124 of each rail 120 inserts into the corresponding groove 108 of the enclosure 40 to interconnect the strong back 42 and the enclosure 40 in a tongue-and-groove-like manner. The bottom panel 110 of the enclosure 40 sits generally flush against the base plate 122. The rails 120 capture the lower portion of the side walls 80 of the enclosure 40.

FIG. 2 illustrates the bracket 44 assembled with the enclosure 40 and strong back 42. The bracket 44 is inserted into the interior cavity 82 of the enclosure 40. The studs 146 of the bracket 44 are inserted through the aligned holes 112, 136 of the enclosure bottom panel 110 and the base plate 122. The bracket base 140 preferably sits within the recess 114 of the enclosure bottom panel 110. Nuts 192 are threaded on the studs 146 to secure the bracket 44 to the strong back 42. The enclosure bottom panel 110 is interposed between the bracket base 140 and the base plate 122. O-rings or washers (not shown) are preferably positioned over the studs 146 between the bracket base 140 and the enclosure bottom panel 110 to seal the holes 112 in the bottom panel 110.

The actuator 10 is inserted through the rear opening 102 of the enclosure 40 and into the interior cavity 82. As seen in FIG. 2, the front end of the actuator cylinder 30 and rod 18 are extended through the central opening 98 in the front panel 86 of the enclosure 40. The actuator support stud 50 is positioned between the legs 142, 144 of the bracket 44, and the actuator 10 is rotated to align the aperture 52 of the support stud 50 with the holes 150 in the bracket legs 142, 144. A pin (not shown) is inserted through the aligned holes 52, 150 to fix the support stud 50 to the bracket 44.

As mentioned above, the axis of holes 150 of the bracket 44 is preferably slanted relative to the base 140 so as to position the actuator 10 within the enclosure 40 at a slight angle. So positioned, the transverse height of the enclosure 40 can be reduced to decrease material costs. The actuator 10 is preferably skewed relative to the transverse axis by about 15°.

The extender 54 is threaded onto the actuator rod 18, with the collar 70 interposed therebetween. As seen in FIG. 2, the extender 54 preferably extends beyond the front edge 138 of the strong back 42 when attached to the actuator rod 18.

The bellows 72 is positioned between flange 99 of the enclosure central opening 98 and the collar 70. The bellows 72 desirably has an inner diameter substantially equal to the outer diameter of the annular flange 99 and of the collar 70. A forward end of the bellows 72 slips over the collar 70, and the rear end of the bellows slips over the flange 99.

The bellows 72 is preferably formed of a flexible material, such as, for example, an elastomer. It is also desired that the material of the bellows 72 maintain its structural integrity when used in its intended environment. In an exemplary embodiment, a suitable bellows 72 can be obtained commercially from A & A Co., Part No. Q-108290.

connectors (not shown), such as, for example, hose clamps, available commercially from McMaster-Carr, secure the front end of the bellows 72 to the collar 70 and the rear end of the bellows 72 to the flange 99. The bellows 72 thus can contract and expand as the actuator rod 18, to which the collar 70 is attached, slides in and out of the enclosure 40. In this manner, the bellows 72 seals the central opening 98 between the flange 99 and the collar 70 attached to actuator rod 18.

FIG. 3 illustrates that the rear cap 106 snaps over the flange 104 of the rear access opening 102 to cover the opening 102. A connector (not shown), such as, for example, a hose clamp, available commercially from McMaster-Carr, secures the cap 106 on the flange 104.

As best seen in FIG. 1A, the pair of fasteners 162 attach the support arm 152 of the front mounting attachment to the strong back 42. The bolts of the fasteners 162 are inserted through the aligned holes of the support arm 152, the rail horizontal member 124, the bar 158 and the base plate 120. The corresponding nuts are threaded on the bolts to interconnect these components. The support arm 152 extends beyond the front edge 138 of the strong back 42 when attached.

As illustrated in FIGS. 1 and 2, the housing/actuator assembly is desirably installed on the upper surface 178 of the switch box 14. FIG. 2 best illustrates that the rear end 128 of the strong back 42 is positioned over the mounting studs 132 which extend through the slots 130 in the base plate 122. Nuts 194 are threaded onto the mounting studs 132 and are tightened to attach the rear end 128 of the strong back 42 to the switch box 14.

FIG. 1 illustrates that the front edge 138 of the strong back 42 rests proximate to a front surface 196 of the switch box 14. The support arm 152 advantageously extends slightly beyond the front surface 196 of the switch box 14 at a position just off to the side of the lever 20, in the lateral direction.

FIG. 1A illustrates the front mounting attachment which secures the strong back 42 to the switch box 14. The hook 164 of the clamp 24 is slid onto the lever 20 from the bottom side to couple the clamp 24 to the lever 20. The clamp 24 captures at least the lower edge of the lever 20 in this position. The clamp 24 desirably is positioned adjacent to the front surface 196 of the switch box 14.

The suspension bolt 174 is inserted through the slot 156 of the support arm 152 and through the transverse hole 168 of the clamp 24. The nut 176 is then threaded on the bolt 174 and tightened. As the nut 176 is tightened, the bolt 174 pulls the support arm 152 towards the clamp 24 attached to the lever 20. The nut 176 is tightened until the front edge 138 of the strong back 42 securely sits against the top surface 178 of the switch box 14. The clamp 24 cannot be removed from the level 20 without loosening the nut 176.

If the top surface 178 of the switch box 14 is severely bowed, as illustrated in FIG. 5, the rear mount 26 can be used to secure the rear end 128 of the strong back 42 to the switch box 14. The rear mount 26 acts as a wedge placed between the strong back 42 and the switch box 14 to stabilize the housing 12.

As seen in FIG. 5, the rear mount 26 is attached to the bottom side of the strong back 42. The front hole 186 of the rear mount 26 is inserted over the rear stud 146 of the bracket 44. The nut 192 threads on the stud to interconnect the rear mount 26 and the strong back 42, as well as to interconnect the bracket 44 and the strong back 42. The rear hole 188 of the rear mount 26 is aligned with the rear mount hole 134 of the strong back 42. A bolt (not shown) is inserted through the aligned holes 188, 134 and attached via a nut (not shown).

The mounting studs 132 of the switch box 14 extend through the slots 190 of the feet 182 of the rear mount 26 and through the slots 130 of the base plate 122 when the strong back 42 is positioned on the switch box 14. The strong back 42 is then attached to the switch box 14, as described above.

The interconnection between the connector 96 and a conventional corresponding receptacle connector (not shown) connects the control electronics 32 and the actuator 16 to an electrical power source and to communication lines. The connector 96 desirably is connected to both a main source of electricity, as well as an auxiliary source of electricity. The connector also is connected to a communication line which links the control card 32 to the central control system.

A technician can adjust the travel of the actuator 10 by removing the plug 94 from the access hole 88 in the front panel 86. The technician may then adjust the potentiometers on the control card 32 to achieve the travel required to move the lever 20, and thereby throw the switch 16, as known in the art.

The housing 12 completely seals the actuator 10 and control electronics 32 from the surrounding environment. The seals across the rear opening 102, central opening 98 and access opening 88 are advantageously fluid-tight, so that the housing 12 can be submerged.

When actuated, the actuator 10 exerts a load on the bracket 44. As discussed above, the load is carried by the bracket 44 and the strong back 42 attached to the switch box 14. It has been determined that the enclosure 40 is generally isolated from the load. The enclosure 40 can thus be made of a lighter, less expensive material than the prior metal enclosures to reduce manufacturing costs. Additionally, the plastic enclosure generally seals the actuator within its interior cavity and is substantially corrosive-resistant.

Although this invention has been described in terms of a certain preferred embodiment, other embodiments apparent to those of ordinary skill in the art are also within the scope of this invention. Accordingly, the scope of the invention is intended to be defined only by the claims which follow.

What is claimed is:

1. A housing for an actuator used to switch large power distribution switches employed in electrical utility power grids, said actuator having an actuator body and an actuator rod which is adapted to be coupled to a lever of a power distribution switch which extends from a box housing the switch, said housing comprising:

a hollow, plastic enclosure comprising a bottom surface, a front surface and a pair of opposing side walls, said enclosure defining an internal cavity sized to receive at least a portion of the actuator, said front surface including an aperture which opens into said internal cavity and is sized to receive the actuator rod, said enclosure comprising first and second parallel longitudinal grooves formed in said side walls of said enclosure proximate to said bottom surface;

a rigid strong back comprising first and second longitudinal rails, a portion of each of said first and second rails inserted into said first and second grooves of said enclosure, respectively, to attach said strong back to said enclosure, said strong back having a base plate covering at least a substantial portion of said bottom surface of said enclosure; and a bracket connected to said strong back and positioned within said internal cavity of said enclosure, said bracket configured to fixedly support an end of the actuator opposite the actuator rod.

2. The housing of claim 1, wherein each of said first and second rails generally has an inverted "L" shape formed by a vertical member and a horizontal member, said vertical member attaching to said base plate and said horizontal member attaching to said vertical member at a position above said base plate, said horizontal member extending towards a longitudinal center of said base plate.

3. The housing of claim 2, wherein each groove of said enclosure receives said horizontal member of each of said first and second rails to attach said strong back to said enclosure.

4. The housing of claim 1, wherein said enclosure additionally comprises a rear access opening of a sufficient size to receive the actuator, and a cap which covers said opening.

5. The housing of claim 4, wherein said rear access opening has a generally oval shape.

6. The housing of claim 1, wherein said housing additionally comprises a bellows connected to said front surface of said housing and to the actuator rod to form a seal therebetween.

7. The housing of claim 1, wherein said enclosure completely encloses the actuator body.

8. The housing of claim 1, wherein said bracket comprises a base and a pair of generally upstanding legs, said legs configured to receive a rear end of the actuator therebetween, said base having a sufficient size to stabilize said bracket under a load applied to said legs when the actuator is actuated.

9. The housing of claim 8, wherein said legs define a pair of corresponding apertures, an axis of said apertures being skewed relative to a plane defined by the base of said bracket.

10. The housing of claim 1 additionally comprising a rear mount configured to connect a rear end of said housing to a surface of the switch box.

11. The housing of claim 1 additionally comprising a hook coupled to said strong back and configured to engage the lever of the switch so as to attach a forward end of said housing to the switch box.

12. The housing of claim 11 additionally comprising a support arm attached to said housing, said hook being suspended from said support arm.

13. A housing for an actuator used to switch large power distribution switches employed in electrical utility power grids, said actuator having an actuator rod which is adapted to be coupled to a power distribution switch, said housing comprising:

a non-metallic, hollow enclosure defining an internal cavity sized to receive at least a portion of the actuator, said enclosure comprising an aperture which opens into said internal cavity and is sized to receive the actuator rod;

a strong back attached to said enclosure; and a bracket connected to said strong back and positioned within said internal cavity of said enclosure, said bracket configured to fixedly support an end of the actuator opposite the actuator rod.

14. The housing of claim 13, wherein said strong back comprises a longitudinal rail.

15. The housing of claim 14, wherein said rail forms a channel which receives a portion of said enclosure to attach said strong back to said enclosure.

16. The housing of claim 13, wherein said non-metallic enclosure is formed of plastic.

17. The housing of claim 13, wherein said non-metallic enclosure is formed of a composite.

18. A housing for an actuator used to switch large power distribution switches employed in electrical utility power grids, said actuator having an actuator rod which is coupled to a power distribution switch, said housing comprising:

a hollow enclosure defining an internal cavity sized to receive at least a portion of the actuator, and an aperture which opens into said internal cavity and is sized to receive the actuator rod;

a bracket positioned within said internal cavity to support an end of said actuator; and means for generally isolating said enclosure from mechanical stresses and moments applied to said bracket during actuation of the actuator.

19. The housing of claim 18, wherein said enclosure is formed of plastic.

20. The housing of claim 18, wherein said enclosure is formed of a composite.

21. The housing of claim 18, wherein said means comprises a strong back connected to said bracket.

22. An actuator assembly used to switch a large power distribution switch employed in an electrical utility power grid, said switch having a lever which extends from a box housing the switch, said actuator assembly comprising:

an actuator having an actuator rod which is configured to be coupled to the power distribution switch;

a plastic, hollow enclosure defining an internal cavity sized to receive at least a portion of said actuator, and an aperture which opens into said internal cavity and is sized to receive said actuator rod therethrough, said enclosure comprising a bottom surface;

a strong back attached to said bottom surface of said enclosure, said strong back configured to mount on the box housing the power distribution switch; and a bracket connected to said strong back and positioned within said internal cavity of said enclosure, said bracket supporting an end of the actuator opposite the actuator rod.

23. A method of providing environmental protection to an actuator used to switch large power distribution switches employed in electrical utility power grids, said actuator having an actuator rod which is adapted to be coupled to a power distribution switch, said method comprising the steps of:

forming a plastic enclosure comprising a hollow interior cavity;

positioning a bracket within said interior cavity of said enclosure;

coupling a strong back to said enclosure;

connecting said bracket to said strong back;

inserting an actuator into the interior cavity of said enclosure;

extending the actuator rod through an opening in said enclosure;

fixedly attaching an end of the actuator opposite the actuator rod to said bracket; and sealing said actuator within said enclosure.

24. The method of claim 23, wherein said step of sealing said actuator within said enclosure comprises the step of extending a bellows between said actuator rod and said enclosure.

* * * * *